US011788554B2

(12) United States Patent
Chen et al.

(10) Patent No.: US 11,788,554 B2
(45) Date of Patent: Oct. 17, 2023

(54) ADAPTER FOR INDUCED DRAFT FAN AND INDUCED DRAFT FAN COMPRISING THE SAME

(71) Applicant: Zhongshan Broad-Ocean Motor Co., Ltd., Zhongshan (CN)

(72) Inventors: Xingfu Chen, Zhongshan (CN); Yanhu Lin, Zhongshan (CN); Miao Zhang, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 103 days.

(21) Appl. No.: 17/533,025

(22) Filed: Nov. 22, 2021

(65) Prior Publication Data

US 2022/0082111 A1 Mar. 17, 2022

Related U.S. Application Data

(63) Continuation-in-part of application No. PCT/CN2020/083930, filed on Apr. 9, 2020.

(30) Foreign Application Priority Data

Sep. 2, 2019 (CN) ..... 201910823101.1
Sep. 2, 2019 (CN) ..... 201921444907.1

(51) Int. Cl.
*F04D 29/62* (2006.01)
*F04D 25/08* (2006.01)
*F04D 29/42* (2006.01)

(52) U.S. Cl.
CPC ..... *F04D 29/626* (2013.01); *F04D 25/08* (2013.01); *F04D 29/4213* (2013.01); *F04D 29/4226* (2013.01)

(58) Field of Classification Search
CPC .... F04D 29/626; F04D 25/08; F04D 29/4213; F04D 29/4226; F04D 29/422; F04D 29/706
(Continued)

(56) References Cited

U.S. PATENT DOCUMENTS 4,899,726 A * 2/1990 Waterman ..... F24H 8/006 285/236
5,398,976 A * 3/1995 Webb ..... G01M 3/12 285/236

(Continued)

FOREIGN PATENT DOCUMENTS

CN 207131643 U 3/2018
CN 207333297 U 5/2018

(Continued)

*Primary Examiner* — J. Todd Newton
(74) *Attorney, Agent, or Firm* — MATTHIAS SCHOLL P.C.; Matthias Scholl

(57) ABSTRACT

An adapter for an induced draft fan includes an installation section; a transition section; and an exit section. The installation section and the exit section are disposed on two ends of the transition section, respectively. The installation section includes an inner ring, an outer ring, a connection plate, and a water storage cavity. The outer ring includes a first end and a second end; the first end of the outer ring is connected to the transition section; the second end of the outer ring is connected to a first end of the inner ring via the connection plate. The inner ring, the connection plate, and the outer ring are connected one by one to form the water storage cavity. The outer ring includes at least one drain hole communicating with the water storage cavity; and a drain pipe is disposed on the outer ring.

13 Claims, 11 Drawing Sheets

(58) Field of Classification Search
USPC ..... 122/20 B; 285/236; 126/110 R
See application file for complete search history.

(56) References Cited

U.S. PATENT DOCUMENTS

| | | | | |
|---|---|---|---|---|
| 6,536,378 | B2 * | 3/2003 | Lyons | F24H 8/006 285/236 |
| 2015/0247508 | A1 * | 9/2015 | Lyons | F04D 29/4226 415/206 |
| 2016/0040685 | A1 | 2/2016 | Cheng | |
| 2016/0363346 | A1 * | 12/2016 | Vargo | F24H 9/146 |
| 2018/0094624 | A1 | 4/2018 | Kabasta, Jr. | |
| 2019/0085863 | A1 * | 3/2019 | Lin | F24H 3/065 |
| 2020/0033011 | A1 * | 1/2020 | Deal | F24D 19/08 |
| 2021/0115937 | A1 * | 4/2021 | Lin | F04D 29/083 |
| 2022/0082111 | A1 * | 3/2022 | Chen | F04D 29/422 |
| 2023/0210342 | A1 * | 7/2023 | Lee | A47L 15/486 34/85 |

FOREIGN PATENT DOCUMENTS

| | | | |
|---|---|---|---|
| CN | 207500160 | U | 6/2018 |
| CN | 208417004 | U | 1/2019 |
| CN | 110374926 | A | 10/2019 |
| EP | 1193397 | B1 | 6/2008 |

* cited by examiner

ADAPTER FOR INDUCED DRAFT FAN AND INDUCED DRAFT FAN COMPRISING THE SAME

CROSS-REFERENCE TO RELATED APPLICATIONS

This application is a continuation-in-part of International Patent Application No. PCT/CN2020/083930 with an international filing date of Apr. 9, 2020, designating the United States, now pending, and further claims foreign priority benefits to Chinese Patent Application No. 201910823101.1 filed Sep. 2, 2019, and to Chinese Patent Application No. 201921444907.1 filed Sep. 2, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an adapter and an induced draft fan comprising the same.

A conventional induced draft fan includes a volute and a wind wheel disposed in the cavity of the volute. The wind wheel is driven by the rotation shaft of a motor to rotate. An air duct is disposed on one side of the volute. The air duct includes an inner pipe and an outer pipe. The inner pipe communicates with the cavity and functions as an air outlet channel of the induced draft fan, and the outer pipe surrounds the inner pipe. An annular groove is formed between the outer pipe and the inner pipe; the outer pipe is provided with at least one drainage hole at the bottom of the annular groove, and a drainage pipe is protruded outside the drainage hole. An adapter is installed on the air duct of the induced draft fan and embedded in the annular groove. A sealing ring is disposed between the adapter and the outer pipe, and a positioning mechanism is disposed between the inner pipe and the adapter to limit the circumferential movement of the adapter. A curved groove is disposed at the outer end of the outer pipe. The curved groove extends along the axial and circumferential directions and separates the outer pipe into a fixed part and a movable part. The two ends of the outer pipe are protruded to form a first flange and a second flange. The first flange is disposed on the end face of the outer pipe, and a positioning groove is formed between the first flange and the second flange. The curved groove communicates with the positioning groove, and a locking device is installed in the positioning groove. The locking device interlocks the movable part and the fixed part, so that the outer pipe holds the adapter tightly. The conventional adapter includes many parts, which leads to troublesome assembly and high manufacturing cost; moreover, the connection angle and length between the adapter and the outer pipe are fixed, resulting in poor universality of the adapter

SUMMARY

The disclosure provides an adapter for an induced draft fan, the adapter comprising an installation section; a transition section; and an exit section. The installation section and the exit section are disposed on two ends of the transition section, respectively; the installation section comprises an inner ring, an outer ring, a connection plate, and a water storage cavity; the outer ring comprises a first end and a second end; the first end of the outer ring is connected to the transition section; the second end of the outer ring is connected to a first end of the inner ring via the connection plate; the inner ring, the connection plate, and the outer ring are connected one by one to form the water storage cavity; the outer ring comprises at least one drain hole communicating with the water storage cavity; and a drain pipe is disposed on the outer ring to communicate with the at least one drain hole.

In a class of this embodiment, a second end of the inner ring is bent to form a step.

In a class of this embodiment, the inner ring comprises an inner wall provided with a groove.

In a class of this embodiment, the transition section comprises a flexible pipe comprising a plurality of foldable parts.

In a class of this embodiment, the exit section comprises a connection section and an expansion section; two ends of the connection section are connected to the transition section and the expansion section; an inner diameter of the expansion section is greater than an outer diameter of the connection section, so that a step segment is formed at a joint of the connection section and the expansion section.

In a class of this embodiment, two ends of the expansion section protrude to form a first flange and a second flange, respectively; the first flange is disposed on an end face of the expansion section; and a locating groove is formed between the first flange and the second flange.

In a class of this embodiment, a gap is disposed between the first flange and the locating groove.

In a class of this embodiment, the transition section comprises soft material, and the installation section and the exit section comprises hard material.

In a class of this embodiment, a plurality of steel rims is disposed between the plurality of foldable parts to improve the rigid strength of the adapter and prevents the deformation of the foldable parts.

The disclosure also provides an induced draft fan comprising a volute, a wind wheel, and a motor; the volute comprises a housing, a cover plate disposed on a bottom end of the housing, and a cavity formed by the housing and the cover plate to accommodate the wind wheel; the cover plate comprises an air inlet; one side of the housing comprises an air duct; an air outlet is disposed on one end of the air duct; the motor comprises a rotation shaft; the motor is disposed on a top of the housing, and a front end of the rotation shaft extends into the cavity and is engaged with the wind wheel; the abovementioned adapter is connected to the air outlet; and an inner wall of the inner ring is attached to an outer surface of the air duct.

In a class of this embodiment, a second end of the inner ring is bent to form a step; and an end part of the air duct abuts against the step.

In a class of this embodiment, the inner wall of the inner ring comprises a groove; the outer surface of the air duct is provided with a protrusion; and the protrusion is embedded in the groove when the adapter is connected to the air duct.

Further, the disclosure provides a fan system, comprising the above-mentioned induced draft fan and a connection pipe; the air duct of the induced draft fan is connected to the connection pipe via the adapter; and the plurality of foldable parts of the transition section is connected to the connection pipe.

The following advantages are associated with the induced draft fan of the disclosure.

The adapter comprises an installation section; a transition section; and an exit section. The installation section and the exit section are disposed on two ends of the transition section, respectively; the installation section comprises an inner ring, an outer ring, a connection plate, and a water storage cavity; the outer ring comprises a first end and a second end; the first end of the outer ring is connected to the transition section; the second end of the outer ring is connected to a first end of the inner ring via the connection plate; the inner ring, the connection plate, and the outer ring are connected one by one to form the water storage cavity; the outer ring comprises at least one drain hole communicating with the water storage cavity; and a drain pipe is disposed on the outer ring to communicate with the at least one drain hole. In this way, the connection of the adapter to a load is easy, and that the at least one drain hole communicates with the water storage cavity is favorable to the discharge of condensed water.

The induced draft fan comprises a volute, a wind wheel, and a motor; the volute comprises a housing, a cover plate disposed on a bottom end of the housing, and a cavity formed by the housing and the cover plate to accommodate the wind wheel; the cover plate comprises an air inlet; one side of the housing comprises an air duct; an air outlet is disposed on one end of the air duct; the motor comprises a rotation shaft; the motor is disposed on the top of the housing, and a front end of the rotation shaft extends into the cavity and is engaged with the wind wheel; the adapter is connected to the air outlet; and the inner wall of the inner ring is attached to the outer surface of the air duct, thus simplifying the installation of the air duct with the adapter, saving the use of the parts, and reducing the installation costs.

The fan system comprises an induced draft fan and a connection pipe; the air duct of the induced draft fan is connected to the connection pipe via the adapter; and the plurality of foldable parts of the transition section is connected to the connection pipe. Thus, the installation angle and the length of the adapter is adjustable, which is conducive to adapting to different loads, thus improving the universality of the adapter.

DETAILED DESCRIPTION

To further illustrate, embodiments detailing an adapter and an induced draft fan comprising the same are described below. It should be noted that the following embodiments are intended to describe and not to limit the disclosure.

Example 1

Figure 1:
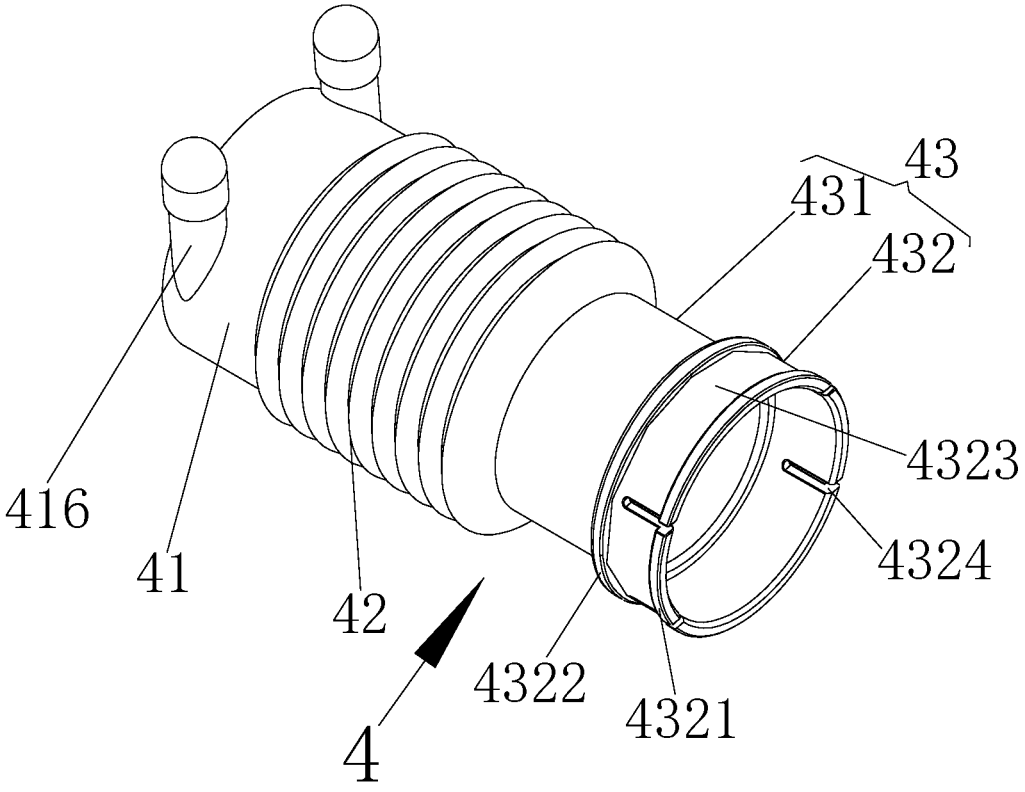
FIG. 1 is a first schematic diagram of an adapter of the disclosure.
Figure 2:
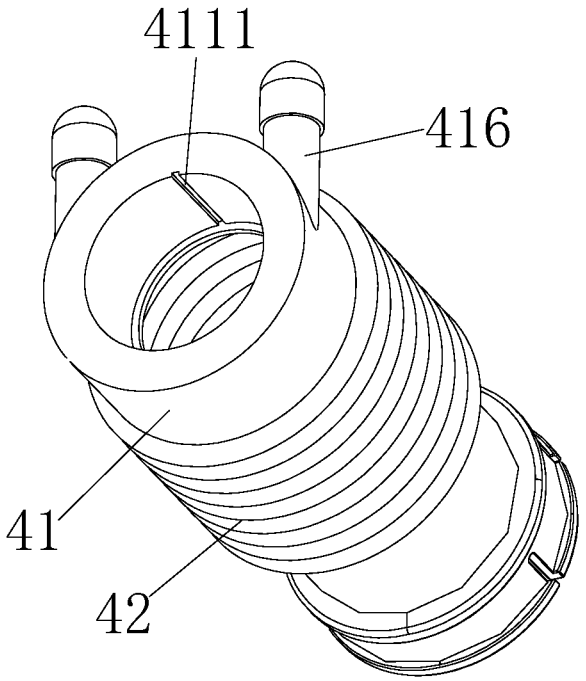
FIG. 2 is a second schematic diagram of an adapter of the disclosure.
Figure 3:
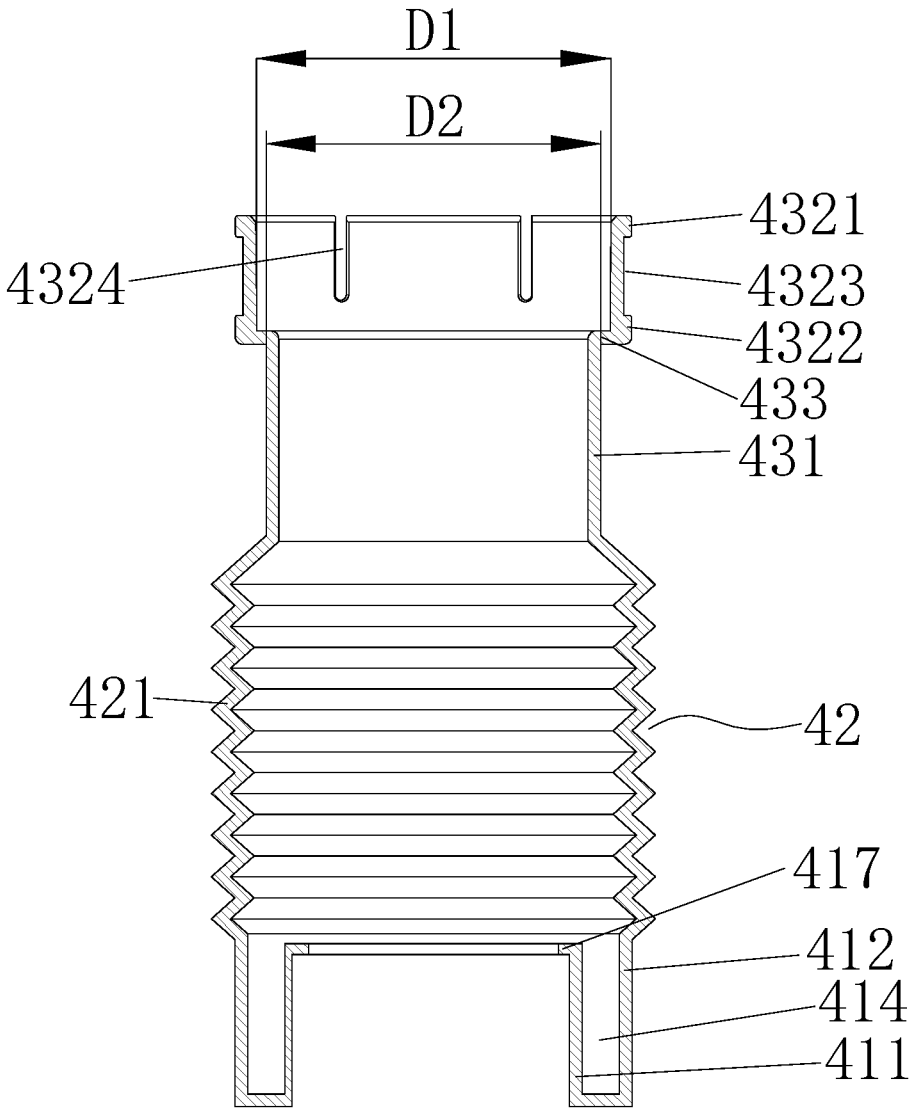
FIG. 3 is a sectional view of an adapter of the disclosure.
Figure 4:
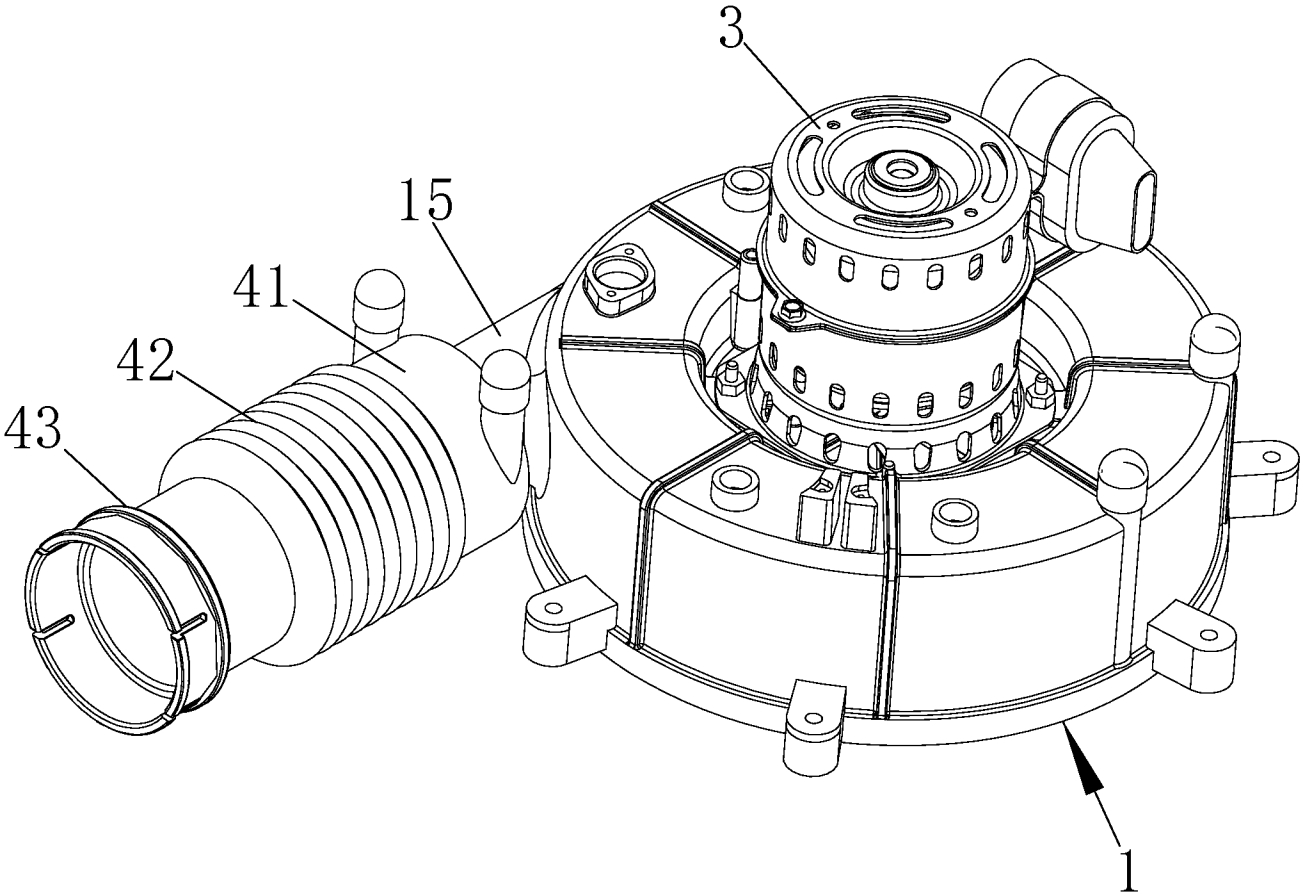
FIG. 4 is a first schematic diagram of an induced draft fan of the disclosure.
Figure 5:
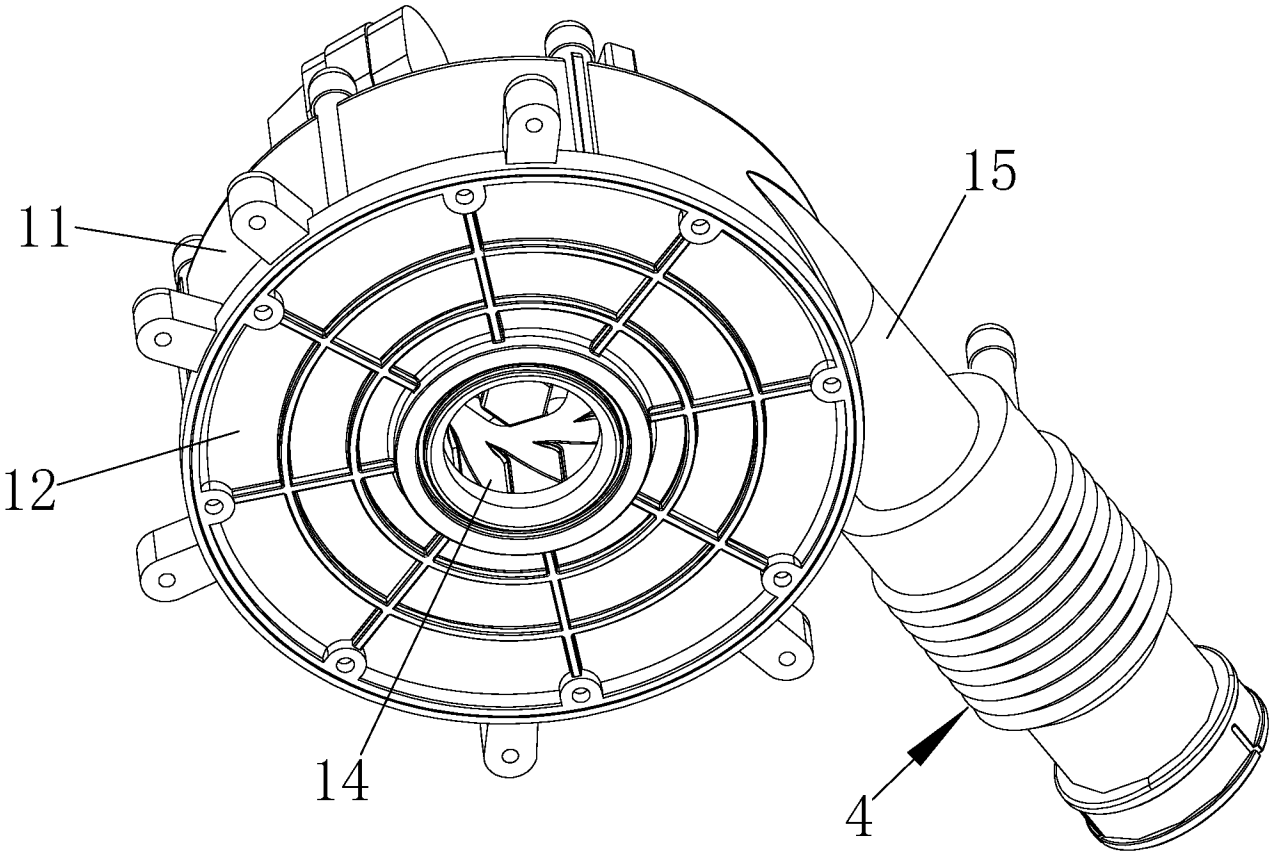
FIG. 5 is a second schematic diagram of an induced draft fan of the disclosure.

As shown in FIGS. 1-3, the disclosure provides an adapter for an induced draft fan. The adapter 4 comprises an installation section 41; a transition section 42; and an exit section 43. The installation section 41 and the exit section 43 are disposed on two ends of the transition section 42, respectively; the installation section 41 comprises an inner ring 411, an outer ring 412, a connection plate 413, and a water storage cavity 414; the outer ring 412 comprises a first end and a second end; the first end of the outer ring 412 is connected to the transition section 42; the second end of the outer ring 412 is connected to a first end of the inner ring 411 via the connection plate 413; the inner ring 411, the connection plate 413, and the outer ring 412 are connected one by one to form the water storage cavity 414; the outer ring 412 comprises at least one drain hole 415 communicating with the water storage cavity 414; and a drain pipe 416 is disposed on the outer ring 412 to communicate with the at least one drain hole 415. In this way, the connection of the adapter to a load is easy, and that the at least one drain hole 415 communicates with the water storage cavity 414 is favorable to the discharge of condensed water.

The second end of the inner ring 411 is bent to form a step 417, which is favorable to the axial positioning of an air duct.

The inner ring 411 comprises an inner wall provided with a groove 4111, which facilitates the installation of the air duct.

The transition section 42 comprises a flexible pipe comprising a plurality of foldable parts 421, which is suitable for the installation of different external pipes.

The exit section 43 comprises a connection section 431 and an expansion section 432; two ends of the connection section 431 are connected to the transition section 42 and the expansion section 432; the inner diameter D1 of the expansion section 432 is greater than the outer diameter D2 of the connection section 431, so that a step segment 433 is formed at a joint of the connection section 431 and the expansion section 432.

Two ends of the expansion section 432 protrude to form a first flange 4321 and a second flange 4322, respectively; the first flange 4321 is disposed on an end face of the expansion section 432; and a locating groove 4323 is formed between the first flange 4321 and the second flange 4322. Thus, the air ducts with different diameters can be selected to be compatible with the volute, so as to improve the performance of the induced draft fan.

A gap 4324 is disposed between the first flange 4321 and the locating groove 4323. The transition section 42 comprises soft material, such as rubber, silicone, and thermoplastic polyurethane (TPU), and the installation section 41 and the exit section 43 comprises hard material, such as hard plastics, metals, and alloys.

A plurality of steel rims is disposed between the plurality of foldable parts 421 to improve the rigid strength of the adapter and prevents the deformation of the foldable parts 421.

Example 2

As shown in FIGS. 4-11, the disclosure also provides an induced draft fan, comprising a volute 1, a wind wheel 2, and a motor 3; the volute 1 comprises a housing 11, a cover plate 12 disposed on a bottom end of the housing 11, and a cavity 13 formed by the housing 11 and the cover plate 12 to accommodate the wind wheel 2; the cover plate 12 comprises an air inlet 14; one side of the housing 11 comprises an air duct 15; an air outlet 16 is disposed on one end of the air duct 15; the motor 3 comprises a rotation shaft 31; the motor 3 is disposed on the top of the housing 11, and a front end of the rotation shaft 31 extends into the cavity 13 and is engaged with the wind wheel 2; the adapter 4 of Example 1 is connected to the air outlet 16; and the inner wall of the inner ring 411 is attached to the outer surface of the air duct 15, thus simplifying the installation of the air duct with the adapter 4, saving the use of the parts, and reducing the installation costs.

The second end of the inner ring 411 is bent to form a step 417; and an end part of the air duct 15 abuts against the step 417, thus facilitating the installation and axial positioning of the air duct 15.

The inner wall of the inner ring 411 comprises a groove 4111; the outer surface of the air duct 15 is provided with a protrusion 151; and the protrusion 151 is embedded in the groove 4111 when the adapter 4 is connected to the air duct 15, thus preventing the circumferential rotation of the air duct with respect to the adapter.

Example 3

Figure 6:
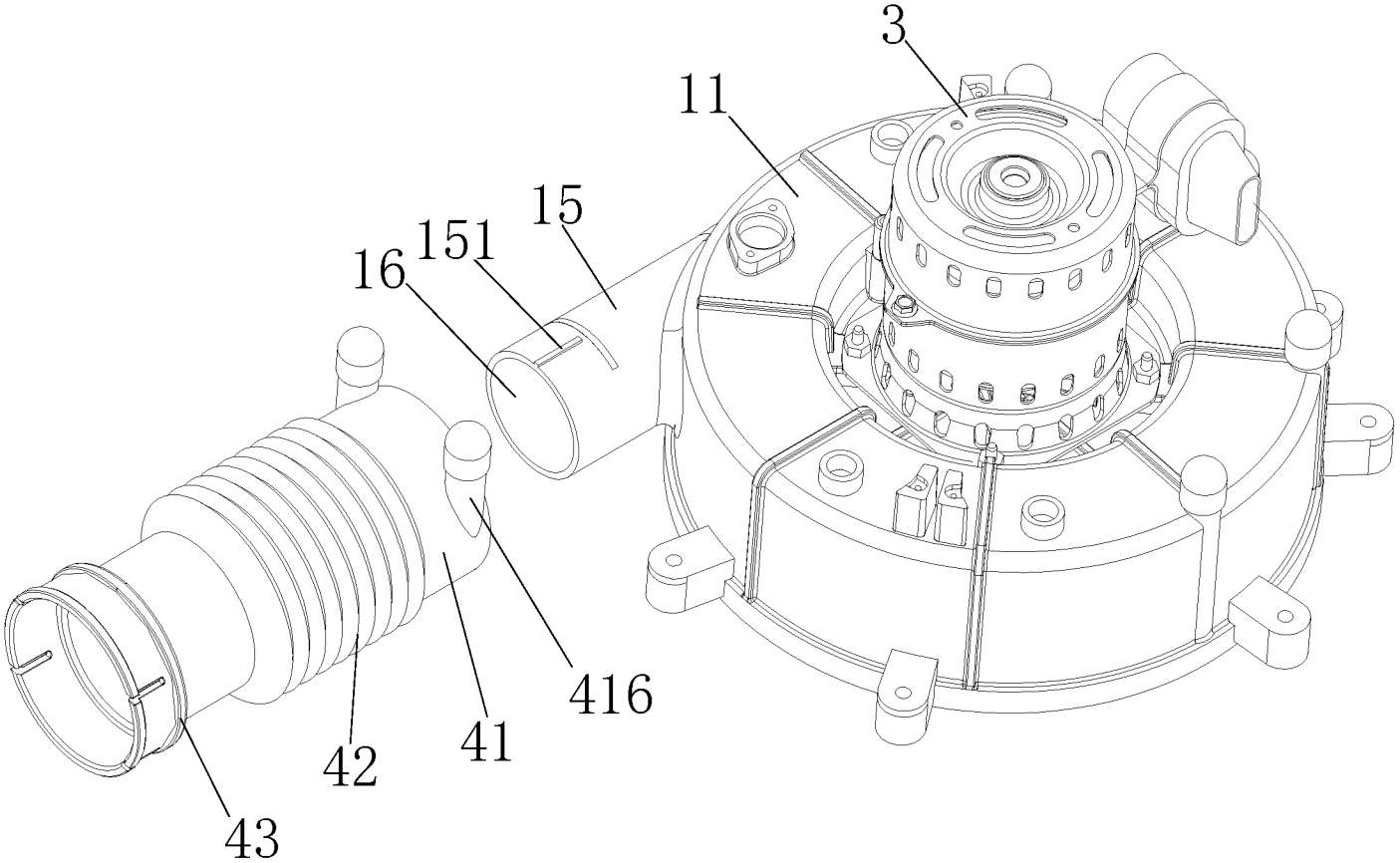
FIG. 6 is a first exploded view of an induced draft fan of the disclosure.
Figure 7:
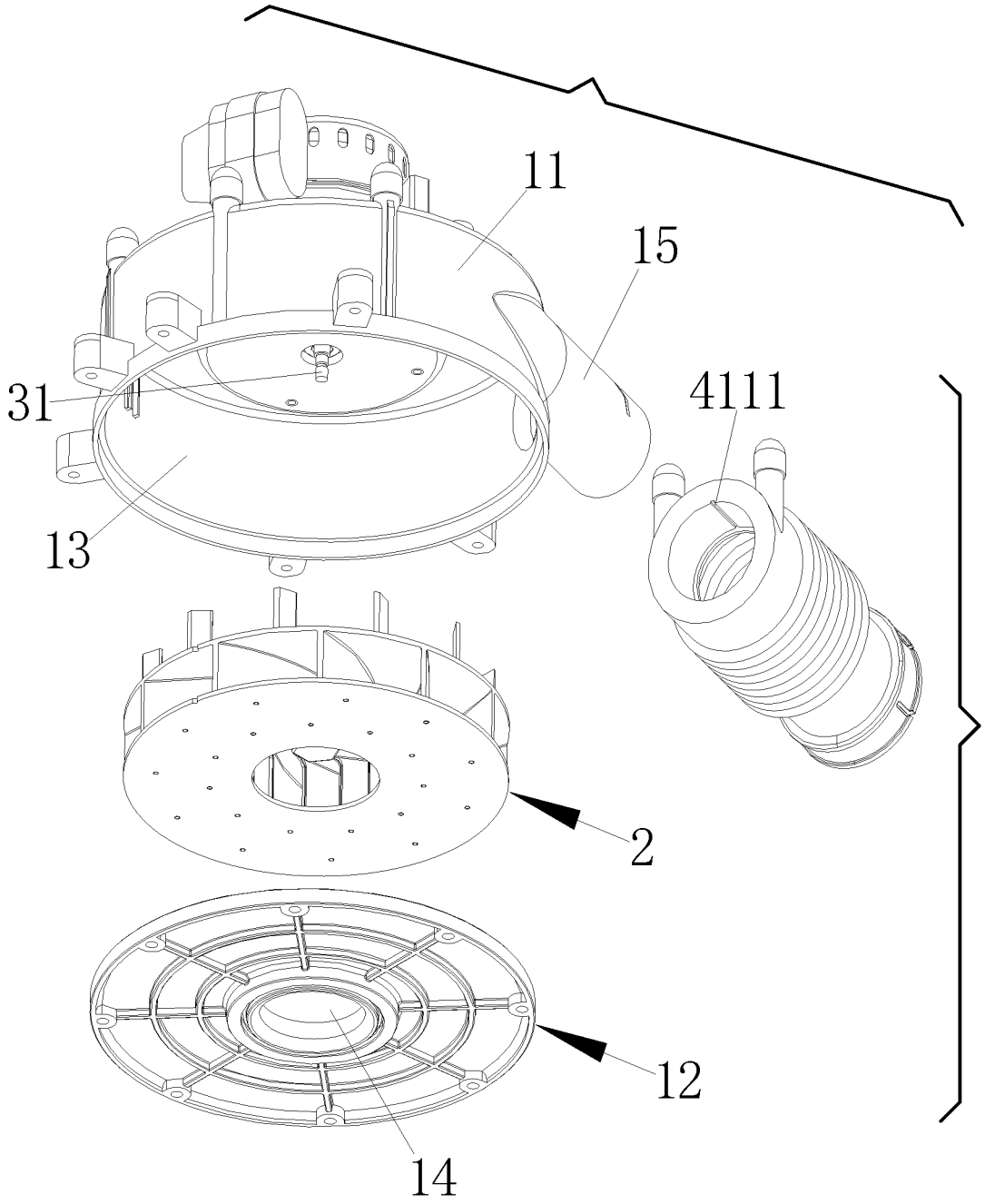
FIG. 7 is a second exploded view of an induced draft fan of the disclosure.
Figure 8:
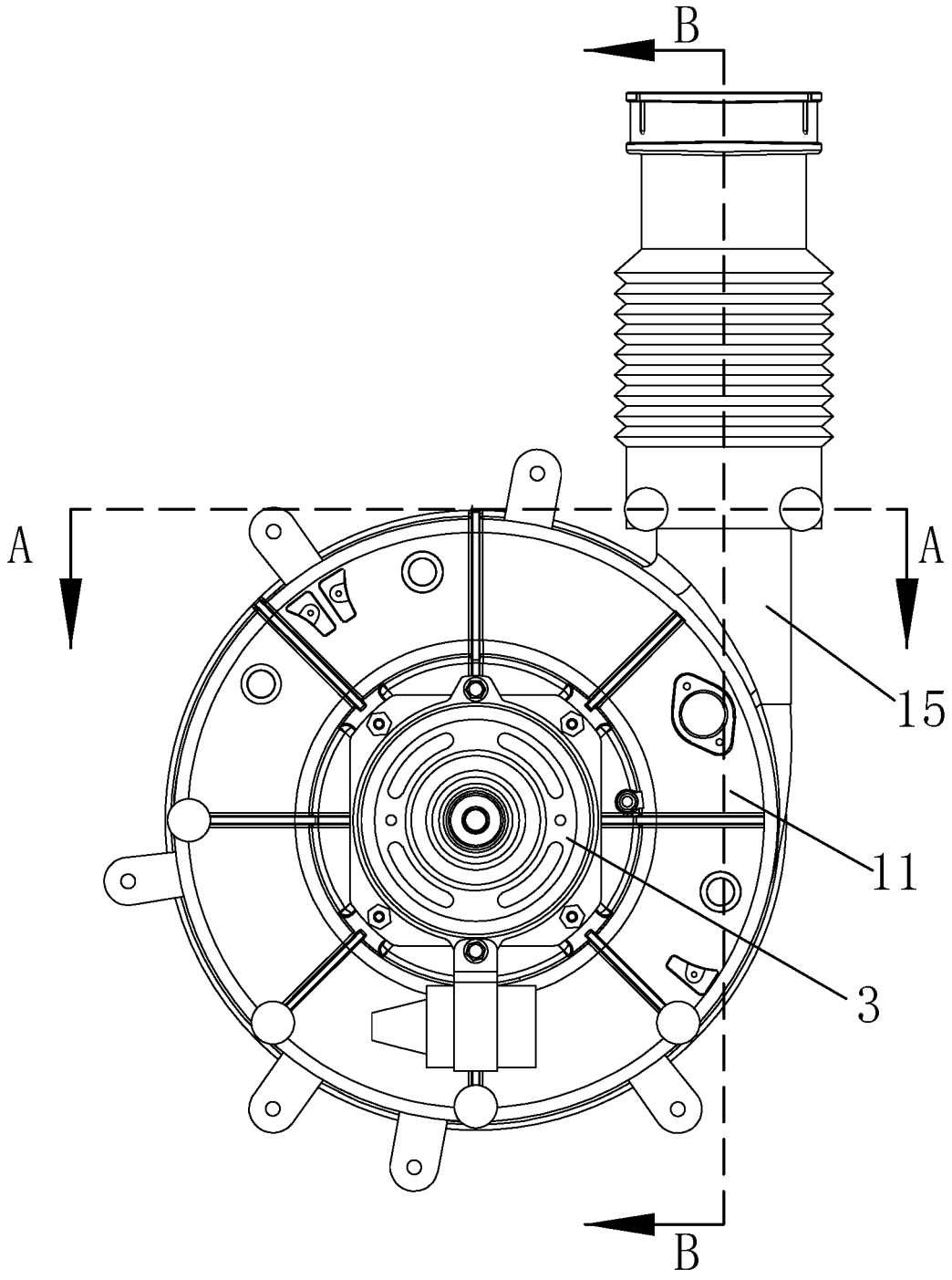
FIG. 8 is a top view of an induced draft fan of the disclosure.
Figure 9:
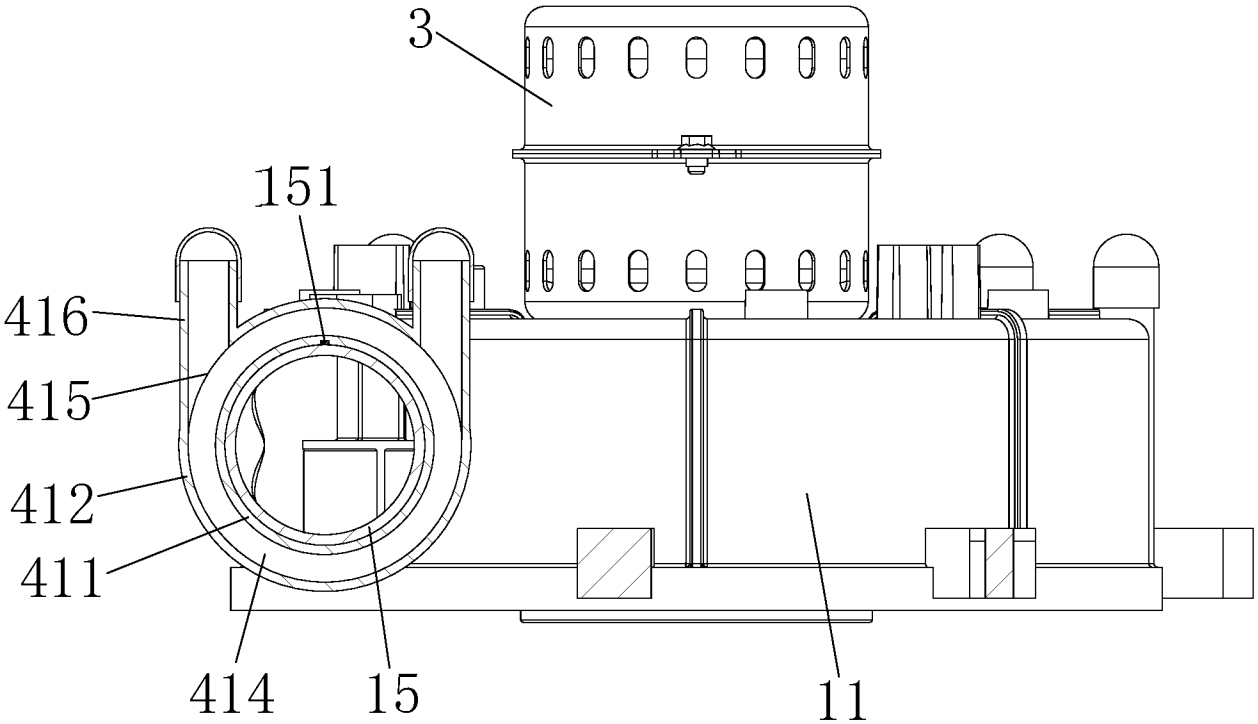
FIG. 9 is an exploded view of an induced draft fan taken from line A-A in FIG. 8.
Figure 10:
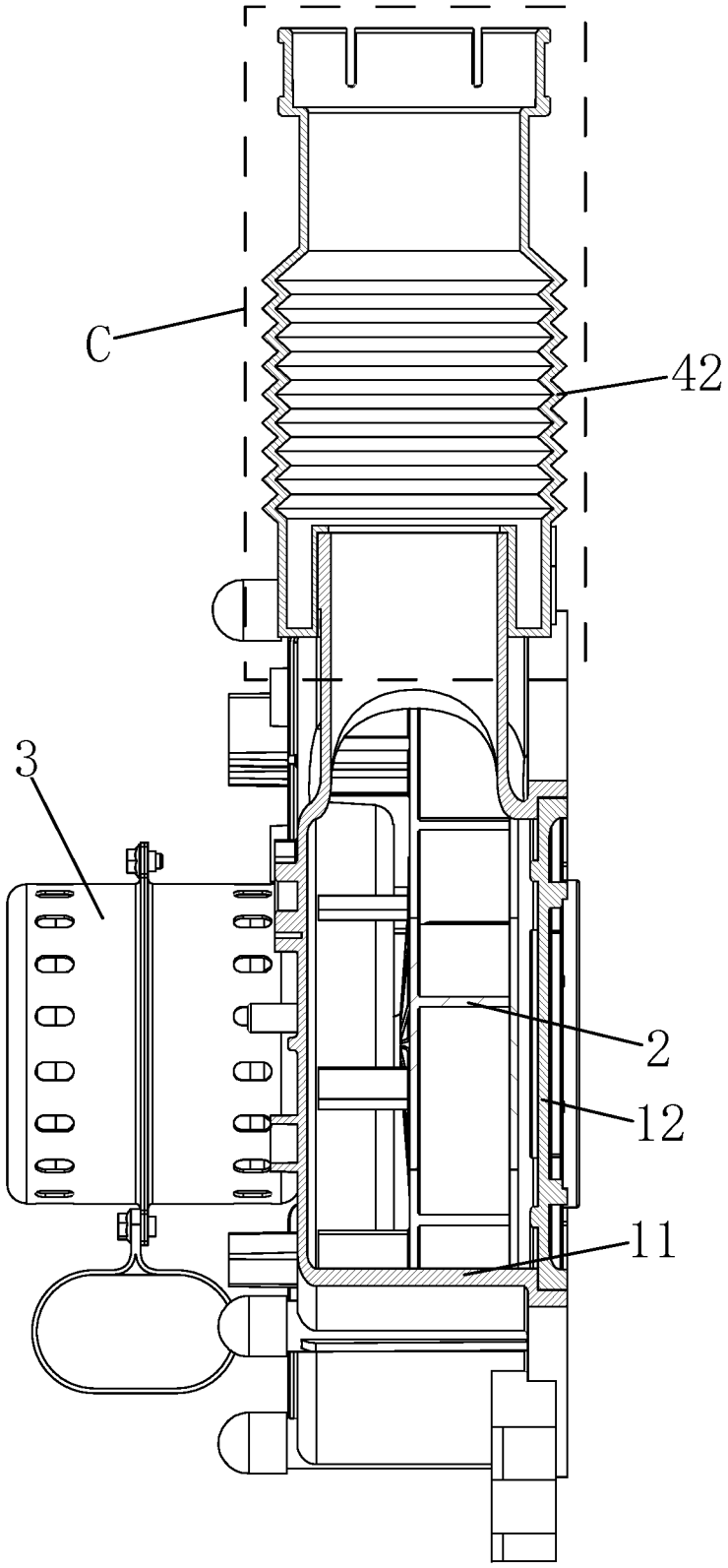
FIG. 10 is an exploded view of an induced draft fan taken from line B-B in FIG. 8.
Figure 11:
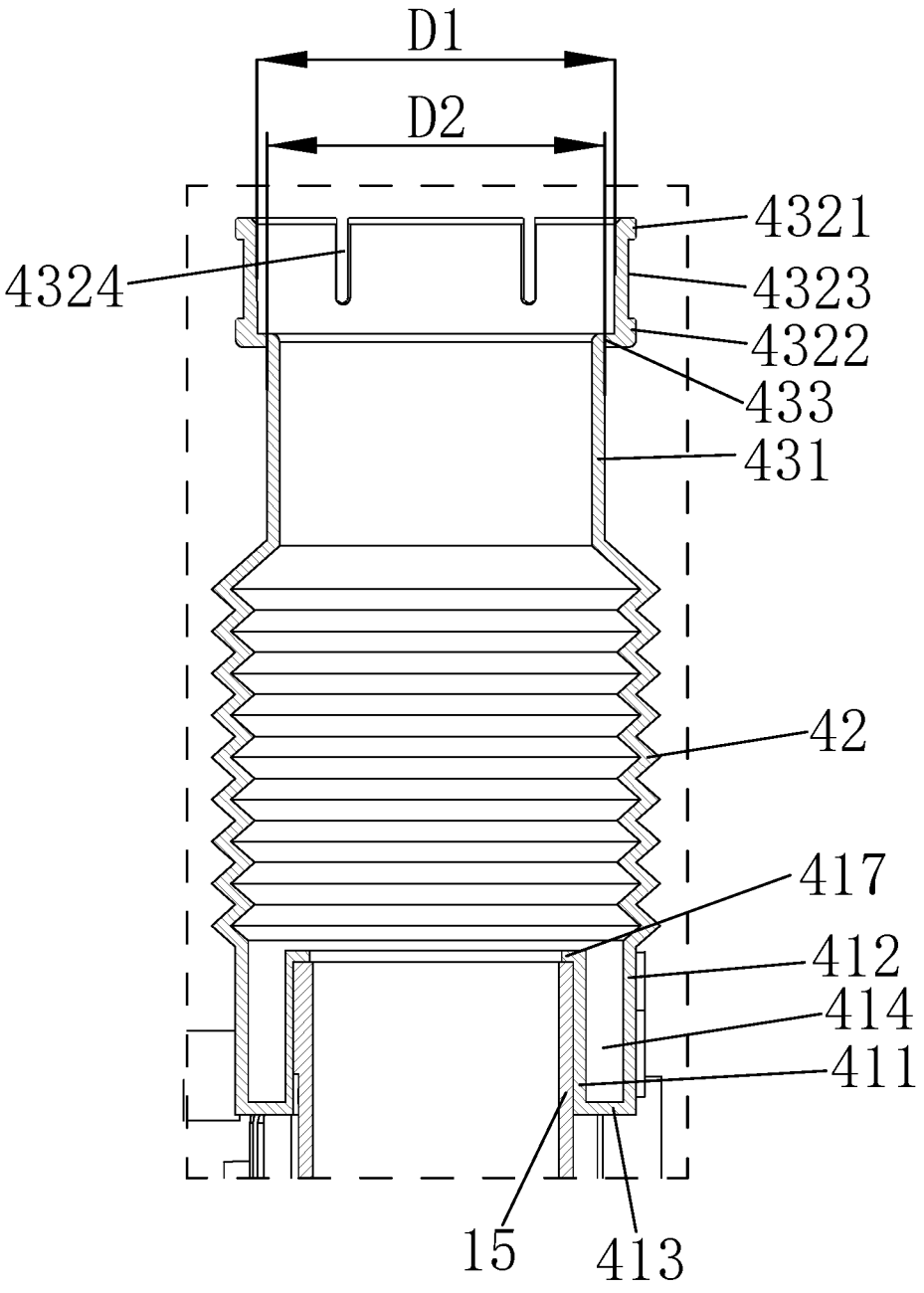
FIG. 11 is a local enlarged view of an induced draft fan in part C in FIG. 10.

As shown in FIGS. 3 and 6, the disclosure also provides a fan system, comprising the induced draft fan in Example 2 and a connection pipe; the air duct 15 of the induced draft fan is connected to the connection pipe via the adapter 4; and the plurality of foldable parts 421 of the transition section 42 is connected to the connection pipe. Thus, the installation angle and the length of the adapter is adjustable, which is conducive to adapting to different loads, thus improving the universality of the adapter.

It will be obvious to those skilled in the art that changes and modifications may be made, and therefore, the aim in the appended claims is to cover all such changes and modifications.

What is claimed is:

1. An adapter for connecting a connection pipe of a load to an induced draft fan, the induced draft fan comprising a duct for discharging air out of the induced draft fan, the adapter comprising:

an installation section;

a transition section; and an exit section;

wherein:

the installation section is adapted to be in contact with and connected to the duct, and the transition section is adapted to be in contact with and connected to the connection pipe of the load;

the installation section and the exit section are disposed on two ends of the transition section, respectively;

the installation section comprises an inner ring, an outer ring, a connection plate, and a water storage cavity; the outer ring comprises a first end and a second end; the first end of the outer ring is connected to the transition section; the second end of the outer ring is connected to a first end of the inner ring via the connection plate;

an inner wall of the inner ring is adapted to be attached to an outer surface of the duct;

the inner ring, the connection plate, and the outer ring are connected one by one to form the water storage cavity;

the outer ring comprises at least one drain hole communicating with the water storage cavity; and a drain pipe is disposed on the outer ring to communicate with the at least one drain hole.

2. An adapter for an induced draft fan, the adapter comprising:

an installation section;

a transition section; and an exit section;

wherein:

the installation section and the exit section are disposed on two ends of the transition section, respectively;

the installation section comprises an inner ring, an outer ring, a connection plate, and a water storage cavity; the outer ring comprises a first end and a second end; the first end of the outer ring is connected to the transition section; the second end of the outer ring is connected to a first end of the inner ring via the connection plate;

the inner ring, the connection plate, and the outer ring are connected one by one to form the water storage cavity;

the outer ring comprises at least one drain hole communicating with the water storage cavity;

a drain pipe is disposed on the outer ring to communicate with the at least one drain hole; and a second end of the inner ring is bent to form a step.

3. The adapter of claim 2, wherein the inner ring comprises an inner wall provided with a groove.

4. The adapter of claim 3, wherein the transition section comprises a flexible pipe comprising a plurality of foldable parts.

5. The adapter of claim 4, wherein the exit section comprises a connection section and an expansion section; two ends of the connection section are connected to the transition section and the expansion section; an inner diameter of the expansion section is greater than an outer diameter of the connection section, so that a step segment is formed at a joint of the connection section and the expansion section.

6. The adapter of claim 5, wherein two ends of the expansion section protrude to form a first flange and a second flange, respectively; the first flange is disposed on an end face of the expansion section; and a locating groove is formed between the first flange and the second flange.

7. The adapter of claim 6, wherein a gap is disposed between the first flange and the locating groove.

8. The adapter of claim 1, wherein the transition section comprises soft material, and the installation section and the exit section comprises hard material.

9. The adapter of claim 4, wherein a plurality of steel rims is disposed between the plurality of foldable parts to improve the rigid strength of the adapter and prevents the deformation of the foldable parts.

10. An induced draft fan, comprising a volute, a wind wheel, and a motor; wherein the volute comprises a housing, a cover plate disposed on a bottom end of the housing, and a cavity formed by the housing and the cover plate to accommodate the wind wheel; the cover plate comprises an air inlet; one side of the housing comprises an air duct; an air outlet is disposed on one end of the air duct; the motor comprises a rotation shaft; the motor is disposed on a top of the housing, and a front end of the rotation shaft extends into the cavity and is engaged with the wind wheel; the adapter of claim 1 is connected to the air duct; and the inner wall of the inner ring is attached to the outer surface of the air duct.

11. The induced draft fan of claim 10, wherein a second end of the inner ring is bent to form a step; and an end part of the air duct abuts against the step.

12. The induced draft fan of claim 11, wherein the inner wall of the inner ring comprises a groove; the outer surface of the air duct is provided with a protrusion; and the protrusion is embedded in the groove when the adapter is connected to the air duct.

13. A fan system, comprising an induced draft fan and a connection pipe; wherein:

the induced draft fan comprises a volute, a wind wheel, a motor, and an adapter;

the volute comprises a housing, a cover plate disposed on a bottom end of the housing, and a cavity formed by the housing and the cover plate to accommodate the wind wheel; the cover plate comprises an air inlet one side of the housing comprises an air duct an air outlet is disposed on one end of the air duct the motor comprises a rotation shaft; the motor is disposed on a top of the housing, and a front end of the rotation shaft extends into the cavity and is engaged with the wind wheel;

the adapter comprises an installation section, a transition section, and an exit section; wherein:

the installation section and the exit section are disposed on two ends of the transition section, respectively;

the installation section comprises an inner ring, an outer ring, a connection plate, and a water storage cavity; the outer ring comprises a first end and a second end; the first end of the outer ring is connected to the transition section; the second end of the outer ring is connected to a first end of the inner ring via the connection plate;

the inner ring, the connection plate, and the outer ring are connected one by one to form the water storage cavity;

the outer ring comprises at least one drain hole communicating with the water storage cavity;

a drain pipe is disposed on the outer ring to communicate with the at least one drain hole;

the adapter is connected to the air duct; and an inner wall of the inner ring is attached to an outer surface of the air duct; and the air duct of the induced draft fan is connected to the connection pipe via the adapter; and the transition section comprises a flexible pipe having a plurality of foldable parts, and the plurality of foldable parts is connected to the connection pipe.

* * * * *